United States Patent [19]

Battersby et al.

[11] 3,980,450

[45] Sept. 14, 1976

[54] GASOLINE COMPOSITION

[75] Inventors: John Battersby, Frimley; Eric Simon Forbes, Lightwater, both of England

[73] Assignee: The British Petroleum Company Limited, London, England

[22] Filed: Aug. 5, 1974

[21] Appl. No.: 494,710

Related U.S. Application Data

[62] Division of Ser. No. 408,575, Oct. 23, 1973.

[30] Foreign Application Priority Data

Oct. 27, 1973 United Kingdom ..... 49573/73

[52] U.S. Cl. ..... 44/72

[51] Int. Cl.[2] ..... C10L 1/22

[58] Field of Search ..... 44/72

[56] References Cited

UNITED STATES PATENTS

| | | | |
|---|---|---|---|
| 3,478,096 | 11/1969 | Cyba | 44/74 |
| 3,637,358 | 1/1972 | Cyba | 44/72 |
| 3,849,083 | 11/1974 | Dubeck | 44/72 |

*Primary Examiner*—Allen B. Curtis
*Assistant Examiner*—Y. Harris-Smith
*Attorney, Agent, or Firm*—Morgan, Finnegan, Pine, Foley & Lee

[57] ABSTRACT

A carburettor detergent comprises a compound formula $R—O—R^1—N.R^2.R^3$ where R is a hydrocarbyl group containing at least 20 carbon atoms, $R^1$ is a hydrocarbyl or amino substituted hydrocarbyl group and $R^2$ and $R^3$ are hydrogen or an alkyl group.

4 Claims, No Drawings

GASOLINE COMPOSITION

This is a division of application Ser. No. 408,575, filed Oct. 23, 1973.

This invention relates to amino substituted ethers which are suitable for use as gasoline additives.

In internal combustion engines using gasoline as a fuel and having a carburettor there is a possibility, with some gasolines, of deposits of a gummy or sticky nature being deposited on the carburettor. In order to reduce the formation of these deposits and/or remove them when they are formed, additives are incorporated into the gasoline. These additives are known as carburettor detergents.

According to one aspect of the present invention there is provided a compound of formula

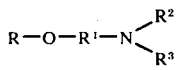

(I)

where R is a hydrocarbyl group containing at least 20 carbon atoms, $R^1$ is a hydrocarbyl or amino substituted hydrocarbyl group and $R^2$ and $R^3$, which may be the same or different, are hydrogen atoms or alkyl groups.

The group R preferably contains from 20 to 500 carbon atoms, most preferably from 30 to 150.

R is preferably a hydrocarbyl group derived from the polymerisation of an olefin. Suitable olefins include ethylene, propylene, butylenes, and 4-methylpentene-1. The preferred olefin is isobutylene.

$R^1$ is preferably a polymethylene group containing 2 to 6 carbon atoms which may also contain an amino group.

Preferred groups $R^1$ are of formulae — $CH_2$ $CH_2$ —, — $CH_2$ $CH_2$ $CH_2$—, — $CH_2$ $CH_2$ $NHCH_2CH_2$ —, — $CH_2CH_2CH_2NHCH_2CH_2CH_2$ —. $R^2$ and $R^3$ are preferably hydrogen atoms or alkyl groups containing 1 to 4 carbon atoms e.g. methyl or ethyl groups.

According to another aspect of the invention there is provided a method of preparing a compound of formula:

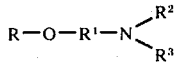

which method comprises reacting an alkanolamine of formula:

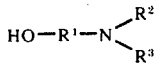

with a metal of Groups IA or IIA of the Periodic Table according to Mendeleef or an oxide, hydroxide or carbonate thereof to form an alkoxide, and reacting the alkoxide with a halide of formula:- R — X wherein R, $R^1$ $R^2$ and $R^3$ are as hereinbefore defined and X is chloride or bromide.

Preferably sodium or potassium hydroxide or metallic magnesium is employed.

The reaction between the alkanolamine and the metal or metal compound preferably takes place in an inert solvent, e.g. xylene, at elevated temperature, suitably at a temperature in the range 100° to 190°C, preferably in the range 140° to 160°C.

Suitable alkanolamines include those of formula $(CH_3)_2NCH_2CH_2CH_2NHCH_2CH_2OH$, $(CH_3CH_2)_2NCH_2CH_2OH$, $NH_2CH_2CH_2OH$ and $NH_2CH_2CH_2NHCH_2CH_2OH$.

According to a further aspect of the present invention there is provided a gasoline composition comprising gasoline and up to 1000 parts per million, preferably 50–200 parts per million of a compound of formula (I) above.

The composition may also contain a lubricating oil in small amount, e.g. 500 ppm.

The invention will now be described with reference to the following Examples.

EXAMPLE 1

A 2 liter flask fitted with a stirrer and a Dean and Stark apparatus was charged with N-(2-aminoethyl) ethanolamine (78g), sodium hydroxide (30g) and xylene (75 mls). The mixture was vigorously stirred and refluxed under nitrogen for four hours during which time water was collected. Chlorinated polybutene (~95C atoms, 4.55% Cl, 975g) in xylene (75 mls) was then added and the mixture was stirred and refluxed for 6 hours at 170°. The mixture was cooled and filtered through Celite and the solvent was removed under vacuum to give a brown oil (% N 1.02%,). A portion was dissolved in heptane, washed thrice with water dried ($MgSO_4$) and the solvent removed under vacuum to give a brown oil (%N 0.84%, residual chlorine content 1.8%).

EXAMPLE 2

Example 1 was repeated replacing the N-(2-aminoethanolamine with an equivalent quantity of

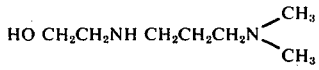

A brown oil containing 0.97% N was recovered.

EXAMPLE 3

A 250 ml three necked flask fitted with a stirrer, dropping funnel and condenser was charged with N-(2-aminoethyl) ethanolamine (15.6g), magnesium turnings (1.8g) and xylene (100 mls). The mixture was refluxed for 1½ hours and chlorinated polybutene (~95C atoms, 4.87% Cl, 33.0g) in xylene (20 mls) was added over 15 minutes. The mixture was stirred and refluxed for a further 5 hours during which time a copious precipitate formed. The mixture was cooled, filtered, washed with water (3 × 100 mls), dried ($MgSO_4$) and solvent removed under vacuum to leave a viscous oil (% N 1.32%, residual chlorine content 1.92%).

In each case the chlorinated polybutene was obtained by chlorination of a polyisobutene sold under the Trade Name Hyvis 30.

The products formed were tested for carburettor detergency properties in a carburettor detergency test which comprises using a Ford 105 E (997 cc) bench engine which is run for 4 hours with a brake loading suficient to produce an inlet manifold depression of 6.5 inches Hg at 1600 r.p.m. (test speed). All crankcase gases are recycled into the air cleaner together with a proportion of exhaust gas. At the end of the test the carburettor is rated visually for deposits and rated on an arbitrary 0 to 10 scale, 10 indicating a clean carburettor.

The following results were obtained.

| Compound | Concentration (ppm) | % N | Rating |
|---|---|---|---|
| None | — | — | 2.5–3 |
| PIB - O $CH_2CH_2NH$ $CH_2CH_2$ $NH_2$ | 140 | 0.84 | 7.5 |
| PIB - O $CH_2CH_2NH$ $CH_2CH_2CH_2$ N($CH_3$)($CH_3$) | 130 | 0.97 | 7.5 |

We claim:

1. A fuel composition comprising gasoline and up to 1,000 parts per million of a carburettor detergent of the formula:

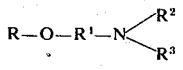

wherein R is a hydrocarbyl group containing from 20 to 500 carbon atoms and derived from the polymerization of isobutylene, $R^1$ is a polymethylene group containing 2 to 6 carbon atoms interrupted by an imino group, and $R^2$ and $R^3$, which may be the same or different are hydrogen atoms or alkyl groups.

2. A composition according to claim 1 wherein $R^2$ and $R^3$, when alkyl groups, contain 1 to 4 carbon atoms.

3. A composition according to claim 1 which contains 50–200 parts per million of the carburetor detergent compound.

4. A composition according to claim 1 wherein $R^1$ is selected from the group consisting of —$CH_2CH_2NH$ $CH_2CH_2$— and —$CH_2CH_2CH_2NHCH_2CH_2CH_2$—.

* * * * *